United States Patent [19]

Jones

[11] Patent Number: 4,773,545

[45] Date of Patent: Sep. 27, 1988

[54] GRIPPING DEVICES FOR HOLDING ELEMENTS THEREIN

[76] Inventor: Graham R. Jones, 6 Pennine View, Great Eccleston, Lancashire, United Kingdom

[21] Appl. No.: 730,424

[22] Filed: May 3, 1985

[30] Foreign Application Priority Data

May 4, 1984 [GB] United Kingdom ..... 8411545
Jan. 23, 1985 [GB] United Kingdom ..... 8501662

[51] Int. Cl.[4] ..... A47F 5/08
[52] U.S. Cl. ..... 211/89; 211/45
[58] Field of Search ..... 211/89, 87, 86, 45; 248/225.1, 205.3, 316.1; 312/187, 190, 242

[56] References Cited

U.S. PATENT DOCUMENTS

| | | | |
|---|---|---|---|
| 793,162 | 6/1905 | Schmidt | 211/89 X |
| 2,530,821 | 11/1950 | Hubbell | 211/45 X |
| 2,783,880 | 3/1957 | Kayton et al. | 211/87 X |
| 2,785,919 | 3/1957 | Grondzik | 211/89 X |
| 3,063,569 | 11/1962 | Huber | 211/89 |
| 3,938,667 | 2/1976 | Buckland | 211/87 |
| 3,946,877 | 3/1976 | Galicia | 248/205.3 X |
| 4,010,517 | 3/1977 | Kapstad | 211/89 X |
| 4,194,635 | 3/1980 | Ferrara | 211/45 |

FOREIGN PATENT DOCUMENTS

| | | | |
|---|---|---|---|
| 1466737 | 12/1966 | France | 211/89 |

*Primary Examiner*—Ramon S. Britts
*Assistant Examiner*—Blair M. Johnson
*Attorney, Agent, or Firm*—Kenyon & Kenyon

[57] ABSTRACT

The disclosure relates to a gripping device (12) for sheets of paper, card or small implements. The device comprises a downwardly open channel section having a base (14) with one vertical side wall (15) to attach to a surface and one inwardly inclined side wall (16). A resilient flap (24) has a base (23) mounted on the inside of wall (15) and extends across the channel mouth to bear on the inner side of wall (16) to trap an edge of a sheet against the wall.

11 Claims, 5 Drawing Sheets

GRIPPING DEVICES FOR HOLDING ELEMENTS THEREIN

BACKGROUND OF THE INVENTION

1. Field of the Invention.

This invention relates to gripping devices for receiving and holding one or more elements or components therein. The device may be used in the office, workshop or home and, as such, may be utilised to hold single or multiple elements or components including tools, domestic utensils such as kitchen implements, office equipment, sheet material such as paper, card, plastics, textile material for screens or curtaining and so on or as a glazing grip for glass or plastics sheeting.

2. DESCRIPTION OF THE PRIOR ART.

U.K. Patent Specification No. 1127357 describes a device for gripping and suspending sheets of paper comprising a horizontal support member having along its underside a series of spaced sheet grippers each consisting of an abutment for engagement by face of a sheet and a resilient gripping member attached to the support member and having an upwardly directed free end for engaging the other face of the sheet and gripping the sheet resiliently against the abutment. Two such support members are provided spaced apart and extending parallel to one another to suspend a series of sheets at opposite corners thereof. The members are relatively narrow engaging the sheets over correspondingly narrow locations providing only limited support for a sheet and not being capable of supporting a plurality of components and in particular differently sized components. Moreover the attachment of the resilient gripping member to the underside of the member creates a heavy and un-attractive structure.

U.K. Patent Publication No. 2007161 discloses a clip for use in a suspension piling system comprising a bifurcate part having two fingers engageable respectively inside and outside the spinal portion of a magazine to grip the spinal portion between them and a hook part engageable over a side rail of a suspension filing system. Again the construction is concerned with gripping a sheet over a limited locality and in particular a corner of a sheet and whilst suitable for suspending sheets, would not be applicable to supporting a multiplicity of elements or components and in particular differently sized elements or components.

SUMMARY OF THE INVENTION

This invention provides a device for holding an element or component therein comprising an elongate socket to receive a part of an element or component and an elongate resilient member (which may be a separate component or may be formed integrally with the socket) extending lengthwise of the socket and being mounted on one side against thereof to the other side of the socket to receive and trap said marginal part against said side of the socket.

The elongate resilient member permits a number of differently sized elements or components to be held in the socket at spaced locations along the socket as well as uniform thickness elements such as sheets of paper or card.

The resilient member may comprise a base mounted on one side of the socket and an upstanding resilient leg extending from the base to bear on the other side of the socket and, more specifically the base of the resilient member may be so mounted in the socket that the leg is bowed by engagement with said side of the socket to trap said marginal part of an element agaist the one side of the socket.

In the latter arrangement the leg may be L-shaped in cross-section, the base of the L forming the base of the resilient member and the upright of the L forming the resilient leg of the member.

The base of the resilient member may lie against the one side of the socket and means are provided in the socket for holding the base against said one side.

Further the means for holding the base of the resilient member against said one side of the socket may comprise an intermediate wall extending partway across the socket parallel to said other side to receive the base member between the wall and said one side of the socket and an upstanding abutment on said one side of the socket at the open end thereof.

In any of the above arrangements the socket may comprise a base and an upstanding pair of convergent side walls with a gap between the edges of the side walls remote from the base to receive the marginal part of the component to be gripped, the inner face of one of the side walls forming said one side of the socket and the inner face of the other side wall forming the other side of the socket.

Also in any of the above arrangements said one face of the socket may have a self-adhesive strip or strips extending lengthwise of the socket to adhere the socket to a further surface or may have one or more key hole slots to receive appropriate headed fixings for mounting the socket.

Furthermore a board may be provided having an elongate recess to receive and hold the socket of the gripping device.

DESCRIPTION OF THE PREFERRED EMBODIMENTS

Figure 1:
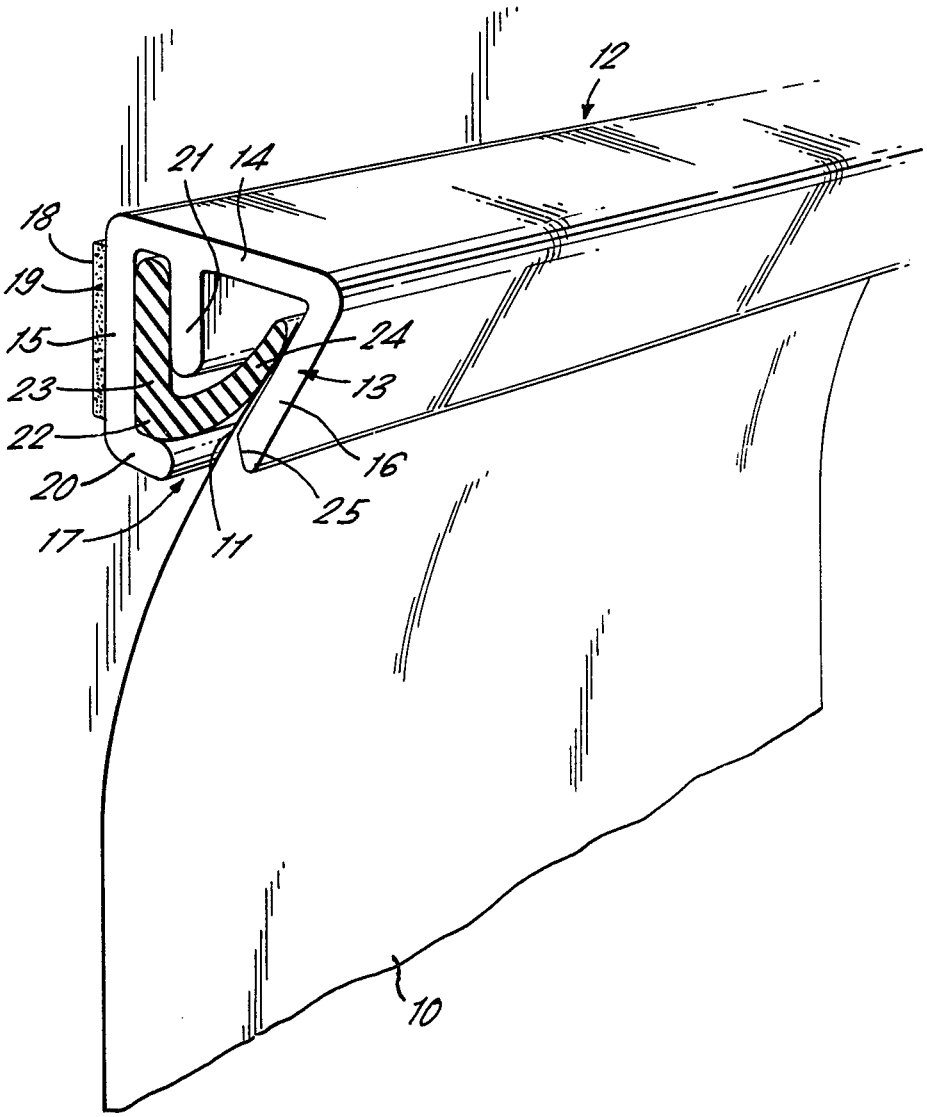
FIG. 1 is a diagrammatic view of an elongate gripping device with a sheet of paper held therein.

Referring firstly to FIG. 1 of the drawings, there is shown a sheet of paper or card 10 which is suspended generally vertically along its upper edge part 11 by an elongate gripping device indicated at 12.

The grip comprises a rigid plastics (e.g. PVC) or aluminum extruded socket indicated generally at 13 comprising a horizontally extending base wall 14 having along one edge a vertically downwardly extending side wall 15 and along the opposite edge a downwardly angled side wall 16 which converges with the side wall 15 to leave a gap indicated at 17 between the lower edges thereof to receive the upper edge 11 of a sheet of paper or card as described below.

The outer face 18 of the side wall 15 of the socket has a double sided adhesive strip or pad 19 thereon to adhere the side wall to a face of a wall, board or other support surface on which the paper grip is to be mounted. The lower edge of the side wall 15 is formed with a laterally extending abutment 20 extending partway across the socket opening 17. The base 14 of the socket is formed with a downwardly extending intermediate partition wall 21 parallel to and spaced from the side wall 15.

An L-shaped flexible extrusion of neoprene rubber or other resilient plastics 22 is mounted in the socket with the base 23 of the resilient extrusion trapped against the side wall 15 by the partition wall 21 and abutment 20. The upright 24 of the L extends across the socket and is "bowed" to bear against the inside face of the angled side wall 16 so that the leg is resiliently biased against the side wall.

The lower edge of the side wall 16 of the socket is chamfered inwardly of the socket as indicated at 25 to form a tapering throat to receive the upper edge of a sheet of paper or card 10 fed through the opening into the socket to guide the edge of the sheet between the resilient leg 24 of the extrusion 22 and the side wall 16 of the socket. The sheet of paper or card forces the leg 24 of the resilient extrusion away from the side wall 16 as the sheet is pressed upwardly into the socket and the resilience in the leg traps and holds the upper edge of the sheet against the side wall 16.

As indicated above, both the socket and resilient member of the paper grip are formed by extrusion and can readily be cut to any suitable length required to suit the particular use to which the grip is to be put. For example a long piece of socket may be provided to receive the whole of an edge of a sheet of paper or card, or short lengths of socket may be mounted at spaced locations to receive the edge of a sheet of paper at different locations along the edge.

Figure 2:
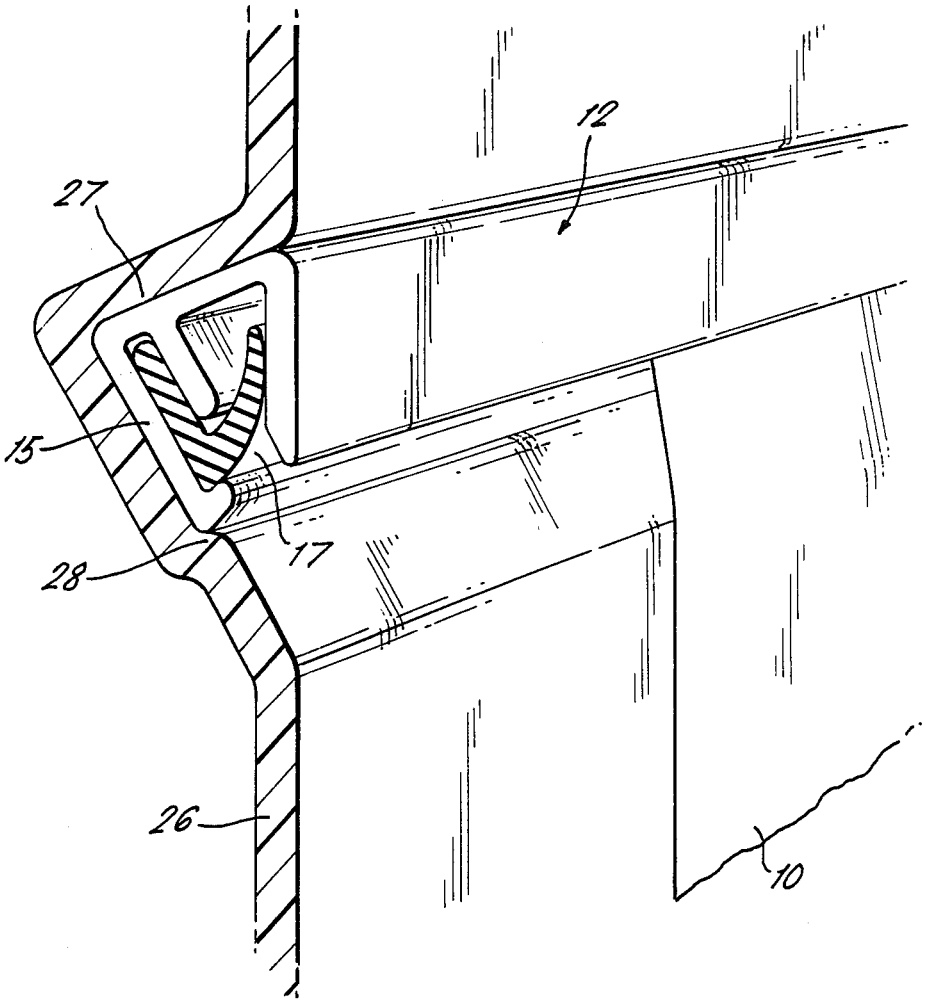
FIG. 2 is a diagrammatic view of a modified form of the device embodied in a board to support the sheet.

FIG. 2 shows a virtually identical socket 12 in which the adhesive strip 19 is omitted and the socket is embodied in a moulded plastics (e.g. vacuum formed from ABS or glass reinforced plastics) backing board 26 formed with a V-shaped recess 27 to receive the base and side 15 of the socket with the opening 17 of the socket facing downwardly over the surface of the board. The board has a moulded rigde 28 against which the lower edge of the side wall 15 of the socket bears to hold the socket in the recess so that the socket is a "snap fit" in the recess.

Glazing (not shown) may also be provided for the board to protect any sheet of paper or card mounted on the board.

Figure 3:
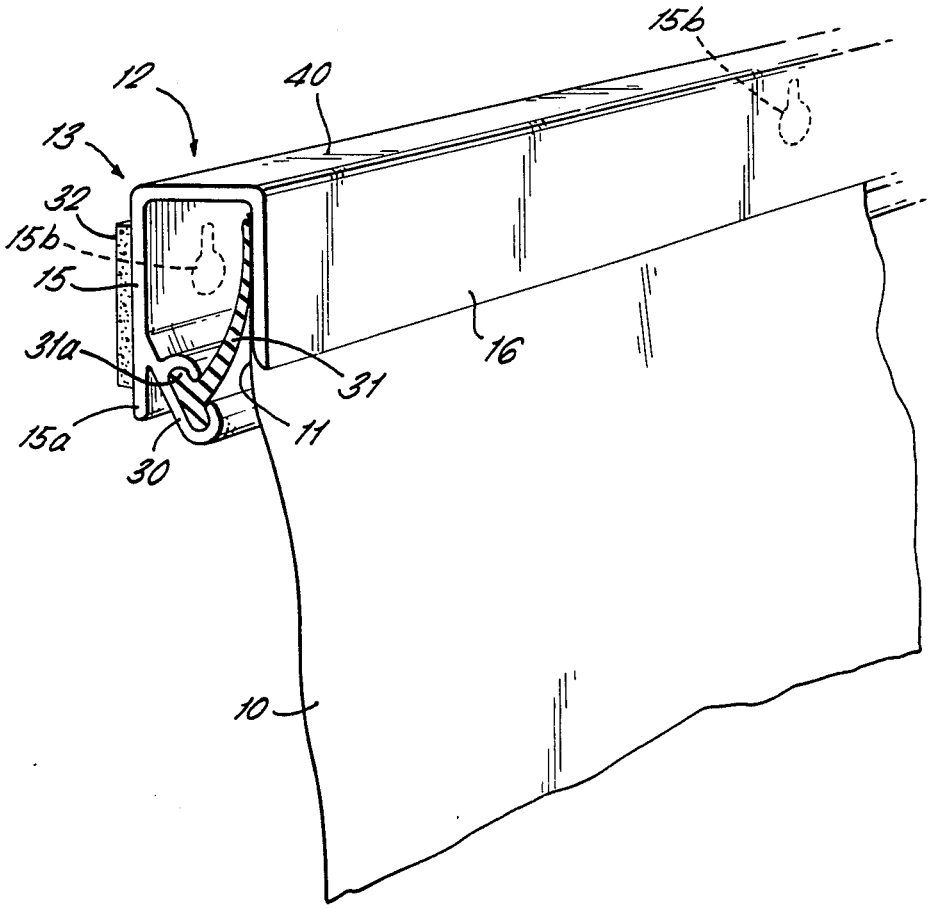
FIGS. 3 and 4 illustrate further embodiments.

Reference is now made to FIG. 3 of the accompanying drawings which illustrates a further embodiment of the invention. Like parts to those of the previously described embodiments have been allotted the same reference numerals. The extruded socket 13 in the embodiment of FIG. 3 is an inverted parallel sided U-shaped channel having a base 40, a rear wall 15 and a front wall 16. The rear wall 15 projects downwardly somewhat further than the front wall 16 and the projecting part of the rear wall is formed with an integral obliquely extending channel 30 which faces generally across the mouth of and into the socket. A resilient flap 31 has a integral base part **31*a* which seats in the channel 30 and the flap extends across the mouth of the socket and along the inner side of the front wall 16 almost to the base 14 of the socket. The channel 30 is so angled that the flap is held in curved or "bowed" form to bear resiliently against the inner side of the front wall to trap a component or element such as the head 11 of a sheet of paper or card 10** against the inside of the front wall to support the piece of paper or card (or other component) suspended from the socket.

The outer side of the rear wall 15 of the socket may have a doubled sided adhesive pads 32 bonded thereto to adhere the socket to the surface of a notice board or suitable backing board. It will be noted that the rear wall 15 of the socket has a downwardly directed extension **15*a* to increase the depth of the wall and thereby provide a deeper base for deeper adhesive pads to provide a more stable mounting for the socket. The extension 15*a* could be extended further to form a backboard integral with the gripping device so that a sheet of paper held in the gripping device can rest against the backboard for writing on, the device and backboard together thus forming a clipboard. In a further arrangement the socket 13** forms a male projection slidably engaged in a corresponding recess in a backboard or other support.

In a still further construction the rear wall of the socket is provided with keyhole slots **15*b*** (shown in dotted outline) spaced along the wall to receive spaced headed pins (not shown) projecting from a surface on which the device is to be mounted.

Figure 4:
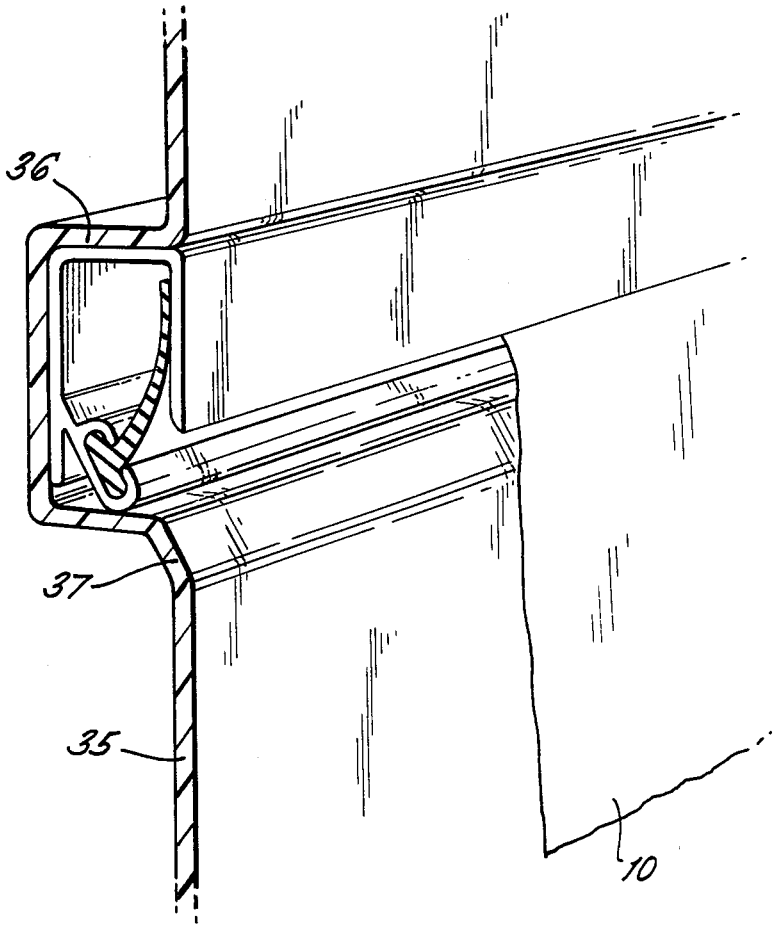

In a the construction shown in FIG. 4, the socket is built into a backing board. The backing board 35 has an integral recess 36 in which socket 12 is mounted, and a bevelled corner 37 is formed between the lower side of the recess and lower part of the board 35 to provide a clear entry for inserting the head of a sheet of paper in the socket. The socket is otherwise identical to that described with reference to FIG. 3. The socket may be bonded into the recess or the recess may be formed so that the walls spring apart to receive the socket and the natural resilience of the backing board clamps the socket in the recess.

In a further construction the socket and resilient flap may be formed as a joint extrusion of suitable plastics materials rather than as separate components as illustrated.

It will be appreciated that in the above embodiments the stiffness of the resilient member may be varied to suit the particular application of the gripping device. Also, although the embodiments illustrate a smooth surface on the resilient member, the surface could be formed with ridges, or a rough surface to enhance gripping of a component or element to be located in the device.

Figure 5:
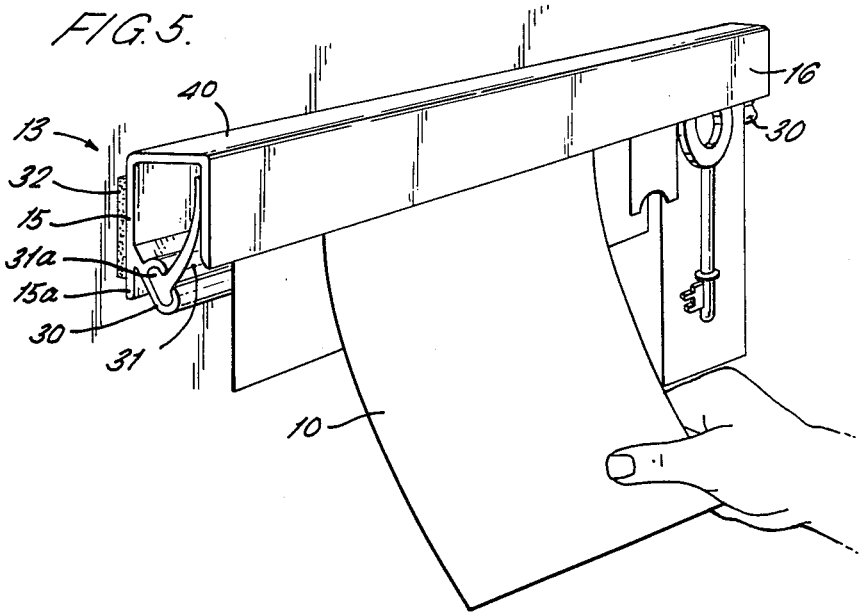
FIGS. 5 and 6 illustrate the FIG. 3 embodiment in use.
Figure 6:
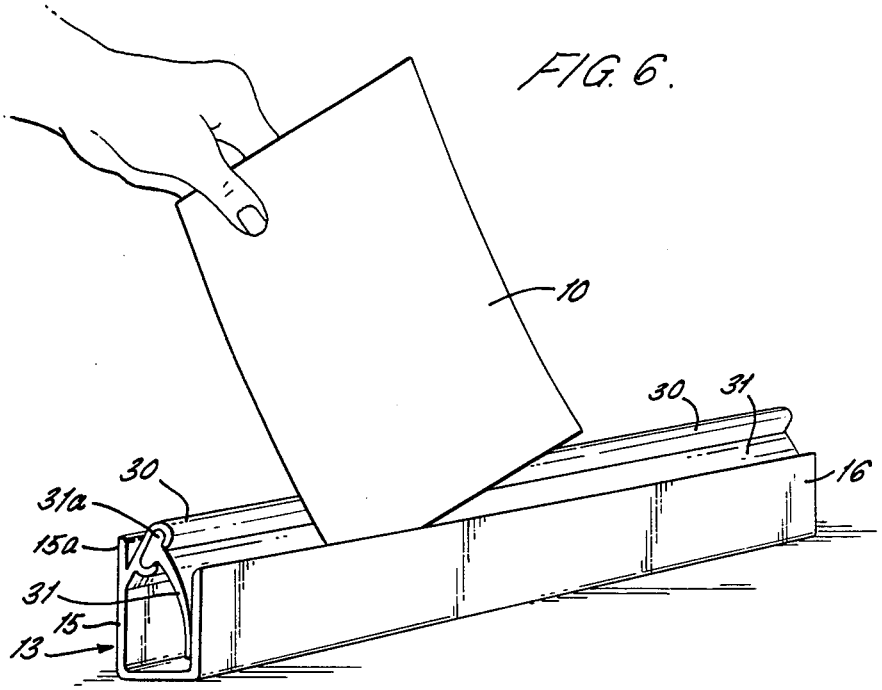

The gripping devices described above are intended for use in the workshop, office or home and may be employed for holding single or multiple implements or utensils such as a set of tools, other small articles or components as well as sheet paper, card or photographic prints or negatives and the length and dimensions of the section are sized accordingly. A suitable length or lengths of the gripping device can also be utilised to support sheets of textile or other like material to serve as screening or curtaining. FIG. 5 shows the gripping device of FIG. 3 in use and holding a multiplicity of different elements including a sheet of paper, a ticket and key at spaced locations along the socket. The gripping device may also be used with the socket open upwardly instead of downwardly as illustrated in FIG. 6. In this mode the device can be used on a desk or work top to hold components. The extruded section may also be joined or formed integral with another device such as a date/time display device or other similar device.

It will be understood that in all the various embodiments described above the dimensions of the socket of the gripping device are varied to suit its intended purpose and in particular the opening of the socket, the length of the socket and the cross-section of the socket are varied according to the application.

A further application of the gripping device is as a glazing bar for glass or plastics panes or sheets. The resilient member both holds the glass or plastics pane in the socket and prevents ingress of moisture. Such glazing bars could form an integral part of a glazed structure such as a greenhouse, cold frame or the like.

I claim:

1. A gripping device comprising:

(a) an elongated socket having first and second longitudinally extending opposed side walls with a base disposed therebetween and including a channel formed at said first side wall and a transverse support length extending along said second side wall;

(b) a resilient member having a base portion and a gripping portion angularly connected thereto, said base portion slidingly received in said channel and said gripping portion resiliently abuting against said transverse support length thereby defining said transverse support length whereby a component to be held by the socket may be frictionally retained between said gripping portion and said second wall over said transverse support length; and (c) means for mounting the gripping device on said first side wall comprising a board having an elongated recess receiving the socket.

2. A device according to claim 1 wherein the socket comprises a unitary part formed from a material selected from the group consisting of aluminum and plastic.

3. A device according to claim 1 wherein the resilient member comprises a unitary piece formed from a material selected from the group consisting of rubber and plastic.

4. A device according to claim 1 wherein said mounting means comprises a self-adhesive strip.

5. A device according to claim 1 wherein said gripping portion comprises an irregular gripping surface.

6. A device according to claim 1 wherein the socket is sized to "snap" fit into the recess such that a component held in the socket lies flush against the board.

7. A device according to claim 1 wherein the socket forms a male projection slidably engaged in a correspondingly shaped recess in the board such that a component held in the socket lies flush against the board.

8. A device according to claim 1 wherein the resilient member is L-shaped in cross section and wherein said socket includes a partition depending from said base disposed intermediate said first and second walls, and an end portion extending angularly from said first wall, said first wall, depending partition and end portion forming said channel.

9. A device according to claim 1 wherein the resilient member is T-shaped in cross section and said channel comprises a receiving member shaped to accept the head of said T angularly extending said first wall.

10. A device according to claim 9 wherein said receiving member defines an oblique angle with said first wall and extends beyond said second wall.

11. A device according to claim 9 wherein said mounting means comprises at least one keyhole slot adapted to receive at least one fixed head mounting element.

* * * * *

UNITED STATES PATENT AND TRADEMARK OFFICE

CERTIFICATE OF CORRECTION

PATENT NO. : 4,773,545

DATED : September 27, 1988

INVENTOR(S) : Graham R. Jones

It is certified that error appears in the above—identified patent and that said Letters Patent is hereby corrected as shown below:

At page 1, between "[76] Inventor:" and "[21] Appln. No.:" please insert -- [73] Assignee: Inoventors Limited Lancashire, United Kingdom Signed and Sealed this Twenty-fifth Day of July, 1989

*Attest:*

*Attesting Officer*

DONALD J. QUIGG

*Commissioner of Patents and Trademarks*